US006073812A

United States Patent [19]

Wade et al.

[11] Patent Number: 6,073,812

[45] Date of Patent: Jun. 13, 2000

[54] FILTERED VENTING SYSTEM FOR LIQUID CONTAINERS WHICH ARE SUSCEPTIBLE TO CONTAMINATION FROM EXTERNAL BIOBURDEN

[75] Inventors: Allan E. Wade, Manchester, Mo.; Keith D. Alsberg; Jon B. Taylor, both of Chicago, Ill.

[73] Assignee: Steris Inc., Temecula, Calif.

[21] Appl. No.: 09/236,997

[22] Filed: Jan. 25, 1999

[51] Int. Cl.[7] ..... B67D 5/58

[52] U.S. Cl. ..... 222/189.09; 222/153.06; 137/68.11

[58] Field of Search ..... 222/189.01, 189.02, 222/189.03, 189.09, 185.1, 325, 188, 442, 481.5, 207, 153.06; 137/68.11, 68.19, 67; 210/464, 466, 467, 488, 489

[56] References Cited

U.S. PATENT DOCUMENTS

| | | | |
|---|---|---|---|
| 3,288,332 | 11/1966 | Etter et al. | 222/189.09 |
| 4,164,306 | 8/1979 | Perrin | 222/181 |
| 4,238,056 | 12/1980 | Tucker et al. | 222/181 |
| 4,416,388 | 11/1983 | Mulawski | 222/207 |
| 4,463,880 | 8/1984 | Kramer et al. | 222/189 |
| 4,533,068 | 8/1985 | Meierhoefer | 222/189 |
| 4,646,945 | 3/1987 | Steiner et al. | 222/207 |
| 4,673,109 | 6/1987 | Cassia | 222/153 |
| 4,778,085 | 10/1988 | Bush et al. | 222/207 |
| 4,930,667 | 6/1990 | Holzner, Sr. | 222/189 |
| 5,082,150 | 1/1992 | Steiner et al. | 222/189 |
| 5,174,476 | 12/1992 | Steiner et al. | 222/181 |
| 5,209,377 | 5/1993 | Steiner et al. | 222/189 |
| 5,265,770 | 11/1993 | Matkovich et al. | 222/189 |
| 5,421,489 | 6/1995 | Holzner, Sr. et al. | 222/207 |
| 5,431,310 | 7/1995 | Kannner et al. | 222/212 |
| 5,439,144 | 8/1995 | Holzner | 222/189.06 |
| 5,927,559 | 7/1999 | Bommer et al. | 222/189.09 |

*Primary Examiner*—Andres Kashnikow
*Assistant Examiner*—Jorge Bocanegra

[57] ABSTRACT

A multi-layer film (22) covers an aperture (21) in a rigid container (10) to provide a filtered venting system (C) for the container. The film includes a porous filter layer (36,36') of a material such as polytetrafluoroethylene foam which filters bioburden from air as it enters the container during the dispensing of a fluid from a nozzle (14) in the container. The film also includes a barrier layer (34,34') of an impermeable material that prevents air from entering the container during transit and storage and prevents blockage of the porous layer with dried fluid. Before dispensing, the film is stretched, thereby destroying the integrity of the barrier layer and allowing air to enter through the porous layer.

27 Claims, 8 Drawing Sheets

FILTERED VENTING SYSTEM FOR LIQUID CONTAINERS WHICH ARE SUSCEPTIBLE TO CONTAMINATION FROM EXTERNAL BIOBURDEN

BACKGROUND OF THE INVENTION

The present invention relates to the fluid dispensing arts. It finds particular application in conjunction with rigid dispensers for liquid detergents susceptible to contamination by airborne microorganisms and other biological matter, and will be described with particular reference thereto. It should be appreciated, however, that the invention is also applicable to the dispensing of other liquids for which airborne contamination is undesirable, such as liquid food concentrates and in medical applications.

Liquid dispensers are widely used for dispensing discrete quantities or charges of detergents, soaps, germicides and other viscous liquid and semi-solid materials. Frequently, the container of liquid is inserted into a wall-mounted housing. Liquid is released in discrete amounts from a nozzle by depression of a lever or other dispensing mechanism.

As fluid is dispensed from the rigid container, a slight vacuum is created and air is drawn into the container, thereby returning the pressure to atmospheric and allowing further amounts of fluid to be dispensed. A simple method of venting the container involves making a small aperture in the container, usually in an upper, fluid free, portion, to allow air to enter without the risk of escape of the fluid through the aperture. This type of venting arrangement is disclosed, for example, in U.S. Pat. No. 4,673,109 to Cassia.

To prevent leakage from the aperture during transit, and contamination or drying of the fluid contents, the vent aperture is either pierced immediately prior to use or formed during manufacture and sealed for transportation.

End user vents are usually formed by puncturing the container manually with any suitable tool such as a punch, awl, or pocket knife. Manufactured vent apertures are usually drilled or molded into the container then sealed in one of a number of ways. One method is to insert a plug into the aperture before filling the container. The plug is removed by the end user prior to use. To prevent leakage around the plug, or loss of the plug during transit, the aperture is precisely drilled. Another method of sealing is to apply an adhesive cover tab over the aperture prior to filling the container, as disclosed, for example, in U.S. Pat. No. 4,673,109 to Cassia. Problems arise, however, if the adhesive used is incompatible with the product and loss of adhesion occurs.

As an alternative to an aperture in the wall of the container, U.S. Pat. No. 4,646,945 to Steiner, et al. discloses a vent mechanism in a closure for a container. A check valve allows air in but prevents product from flowing out. The vent mechanism, however, is expensive to manufacture because of the number and tolerance of the parts.

All the venting methods described above cause unfiltered air to enter the container during dispensing of the product. Air entering the container through the open vent aperture or check valve contains bioburden such as microorganisms and other contaminants. In many cases the product is susceptible to degradation by the bioburden or provides a medium for growth of harmful microorganisms. Contact between the product and the bioburden is particularly enhanced in the case of the check valve, where air entering the container bubbles through the product before collecting in the head space, increasing the susceptibility of the product to the bioburden. Tools used to puncture the container mechanically also introduce bioburden to the product in variable amounts.

Preservatives added to the product counteract the effects of the bioburden to a certain degree but are sometimes overwhelmed by the nature or volume of bioburden entering through the vent. In some cases, preservatives, or significant quantities thereof, are incompatible with the end use of the product and their use is therefore limited.

As a result, a number of systems have been developed for filtering the air to remove bioburden before the air enters the container. In one system, a depression molded into the container includes an aperture at the base of the depression. A filter is inserted into the depression prior to filling the container with product. In use, the filter allows microbe filtered air to enter the container. During transit, however, product frequently passes through the vent aperture and comes into contact with the filter. Air tends to cause the product to dry on the filter, plugging the filter before the container is put into service. This prevents air from entering through the aperture, interfering with the dispensing of the product or encouraging unfiltered air to enter the container through the dispensing mechanism.

In an advancement on the filter system described, U.S. Pat. No. 5,439,144 to Holzner discloses a plug, inserted into the aperture before filling, which prevents the product from coming into contact with the filter during transit. As before, the aperture is in a molded depression in the container, with a filter inserted into the depression. The end user pushes the plug through the aperture, allowing filtered air to enter the container. However, to prevent leakage around the plug, a precisely drilled aperture, rather than a molded aperture is used. The additional parts and assembly considerably increase the cost of the mechanism.

The present invention provides a new and improved filtered venting system for liquid containers which overcomes the above-referenced problems and others.

SUMMARY OF THE INVENTION

In accordance with one aspect of the present invention, a multi-layer film adapted for sealing an opening in a vessel and selectively permitting air substantially free of airborne contamination to pass through the opening is provided. The film includes a first layer of a filter material which is permeable to air but is substantially impermeable to the airborne contaminants and a second layer of a barrier material which is impermeable to air and which fissures when a pressure is applied to a surface of the film permitting filtered air through the film and which is adapted for being sealed around a periphery of the opening.

In accordance with another aspect of the present invention, a fluid dispensing system for dispensing fluids susceptible to airborne contamination is provided. The system includes a reservoir including a container for holding the fluid, a dispensing tube for dispensing fluid from the container, and an aperture defined in the container for admitting air to the container. A multi-layer film covers the aperture and selectively seals the aperture during transit and storage of the container and filters air entering the container during dispensing of the fluid. A housing supports the reservoir.

In accordance with yet another aspect of the present invention, a method for preventing airborne contamination from contaminating the contents of a container with a vent aperture is provided. The method includes:

a) attaching a multi-layer film to the container, the film including a first, barrier layer, which fractures with stretching, to seal the aperture during transit and storage of the container, and a second, porous layer which filters air entering the container through the aperture;

b) shipping or storing the container;

c) fracturing the barrier layer; and, d) filtering out the contaminants from air entering the container through the aperture.

One advantage of the present invention is that it educes contamination of the product within a dispensing container, inexpensively and efficiently, by filtering bioburden from air entering the container.

Another advantage of the present invention is that the filter does not become blocked with dried product during transportation and storage of the dispensing container.

Yet another advantage of the present invention is that the aperture in the container need not be precision drilled.

A further advantage of the present invention is that the vent is readily opened, either manually or automatically.

A yet further advantage of the present invention is that manufacturing the container is simplified.

An additional advantage of the present invention is that the filter provides a leak-proof closure during transit.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENTS

Figure 1:
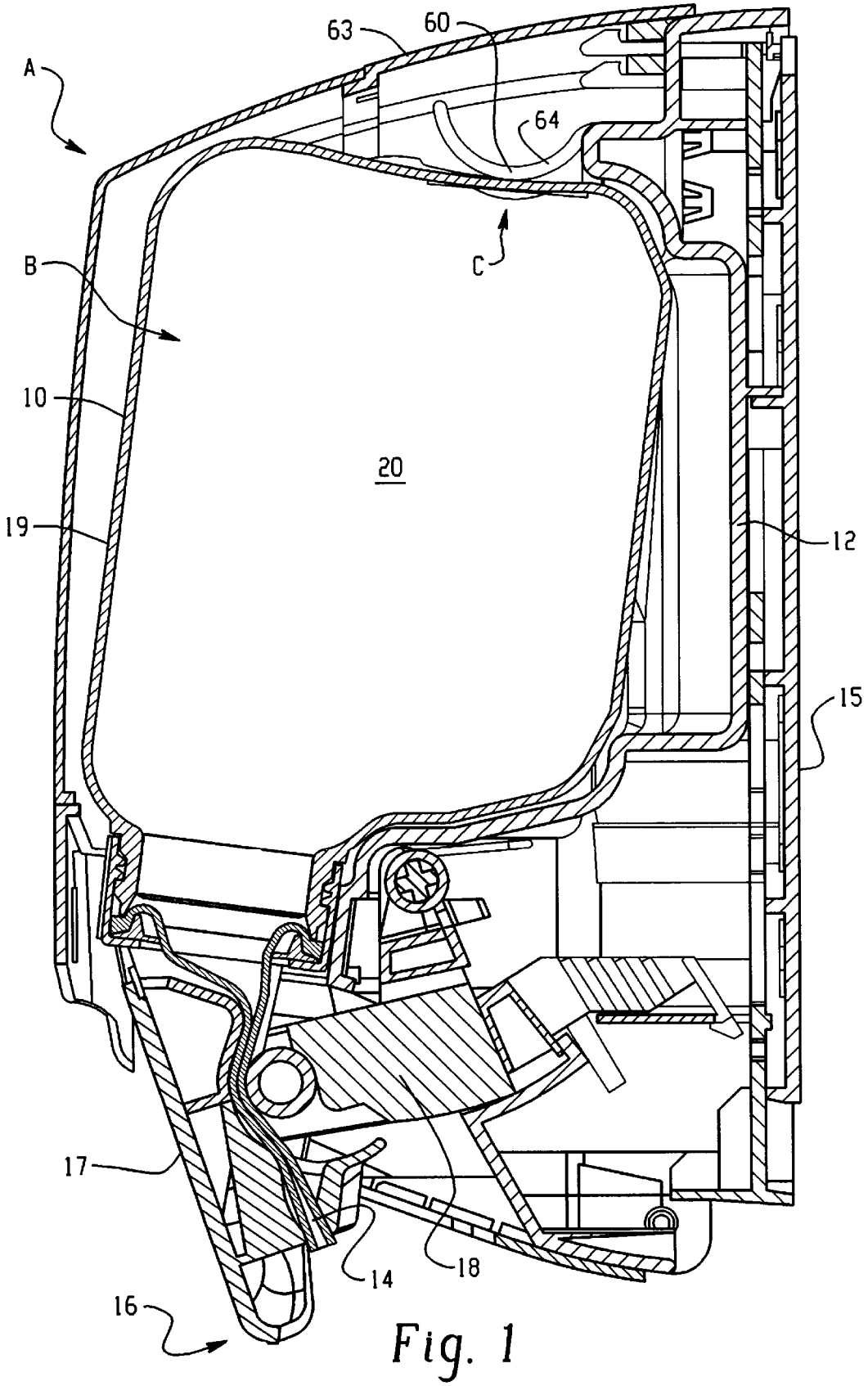
FIG. 1 is a side sectional view of a preferred embodiment of a dispenser according to the present invention.

With reference to FIG. 1, a dispensing apparatus A for dispensing antiseptic soaps, cleaning fluids, other pasty or viscous materials is shown. The apparatus includes replaceable reservoir B, which includes a container 10. The dispensing apparatus also includes a housing 12 for supporting the reservoir. The container 10 is preferably formed from a rigid material is in the form of a plastic bottle or the like. The container serves as a source of the fluid to be dispensed. The reservoir B also includes a dispensing tube, such as a nozzle 14, for dispensing the fluid from the container. The housing 12 is mounted by any suitable mounting system, such as mounting member 15 to a all or other support surface. The reservoir B is replaceably mounted in the housing 12 prior to dispensing.

The dispensing apparatus A preferably includes an actuating mechanism 16 for causing fluid to be dispensed from he nozzle 14 in discrete quantities.

As shown in FIG. 1, one preferred actuating mechanism includes a platen 17 and a roller assembly 18, which is mounted within the housing 12. The nozzle 14 is compressed between the platen 17 and the roller assembly 18 to express the fluid.

Other suitable actuating mechanisms are also contemplated. Another suitable activating mechanism is disclosed in U.S. Pat. No. 4,778,085 to Bush et al. Bush et al. disclose a flexible tube connected to the base of a container, the tube including a check valve. Pressure on an actuator exerts a peristaltic force on the flexible tube forcing a measure of fluid from the container.

Figure 2:
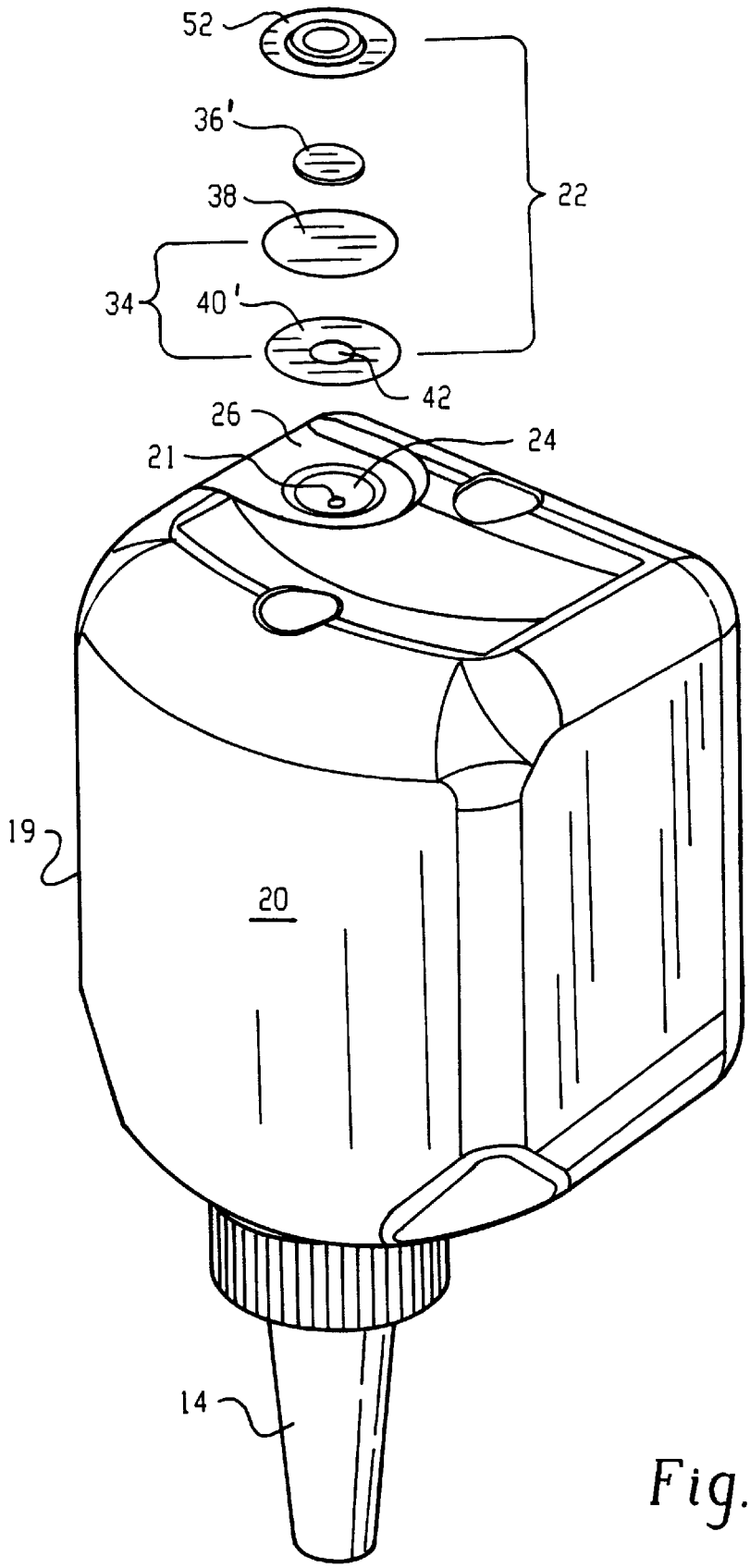
FIG. 2 is an exploded perspective view of the reservoir and filtered venting system of FIG. 1 according to a first embodiment of the present invention.

With reference also to FIG. 2, the container 10 includes a container wall 19 which defines an interior chamber 20 for receiving the fluid. An aperture 21, defined in the container wall, allows for ingress of air as fluid is dispensed. A multi-layer film 22 covers the aperture 21. Together, the aperture and multi-layer film provide a filtered venting system C for the container 10. The film 22 is formed for sealing the aperture 21 during transit and storage and for filtering air entering the aperture during fluid dispensing.

With reference also to FIGS. 3–6, a recess or depression 24 is defined in a side portion 26 of the container wall 19 by a recess wall 28. The side portion of the container wall 19 may be slightly recessed from the container wall, as shown in FIGS. 2–6, to prevent accidental damage to the multi-layer film during transport and storage. The recess wall 28 preferably defines the shape of a cup or hemisphere with an open mouth 30 in the same plane as the side portion 26 of the container 10. Preferably the recess 24 is formed during molding of the container 10, with the recess wall 28 formed from the same material as the side portion 26 of the container 10, although other methods of forming the recess are also contemplated. Aperture 21 is defined in the recess wall 28. A precision hole is not required, and the aperture 21 is readily formed during molding of the container 10 or recess 24. The optimal size of the aperture 21 is dependent on the rate of fluid to be dispensed, but for most purposes an aperture of around 0.1–0.3 cm provides a satisfactory rate of air ingress without unduly reducing the structural strength of the container.

The multi-layer film 22 is sealed to the exterior of side portion 26 around the recess 24 thereby covering the mouth 30 of recess 24 with the multi-layer film. Sealing methods that create an airtight seal and are compatible with the container and its contents may be used. Ultrasonic welding is a particularly preferred method of sealing the film 22 to the container side portion 26. Alternative methods include heat welding, radio-frequency welding, and use of adhesives, such as pressure-sensitive adhesives. Although adhesives provide a simple method of sealing, the choice of adhesive is limited by the solvents used in the fluid. Some solvents dissolve the adhesive, thereby destroying the air-tight seal. Thus, when an adhesive is used it should be chosen to be compatible with the cleaning fluid.

The location of the recess 24 in the container side 26 is such that, during service, fluid within the container 10 is not in close proximity with the film 22. This is to avoid clogging of the film 22 with fluid and subsequent reduction in the rate of air ingress. Typically, side 26 is the uppermost side of the container 10 when the container is positioned for dispensing.

The multi-layer film includes at least a first, barrier layer 34 and a second, filter layer 36. The first, barrier layer is disposed closer to the container side 26 than the filter layer 36 and is preferably sealed to the container side. The barrier layer 34 is preferably resistant to the chemicals used in the fluid so that it is not degraded when in contact with the fluid during transit or dissolved by volatilized solvents escaping from the fluid into the recess 24. The first layer 34 also preferably has a high resistance to permeability of gases so that air does not enter the recess 24 from outside the container 10 during transit and storage and cause drying of the fluid product and blockage of the aperture 21 with dried product. Stretching of the multi-layer film 22 causes cracks to develop in the barrier layer and destruction of the integrity of the barrier layer. The barrier layer 34 may be a single layer of material or a combined layer, which includes a barrier film and a sealing layer. Similar, though not identical, parts of the various embodiments described herein are denoted with a prime (').

Figure 3:
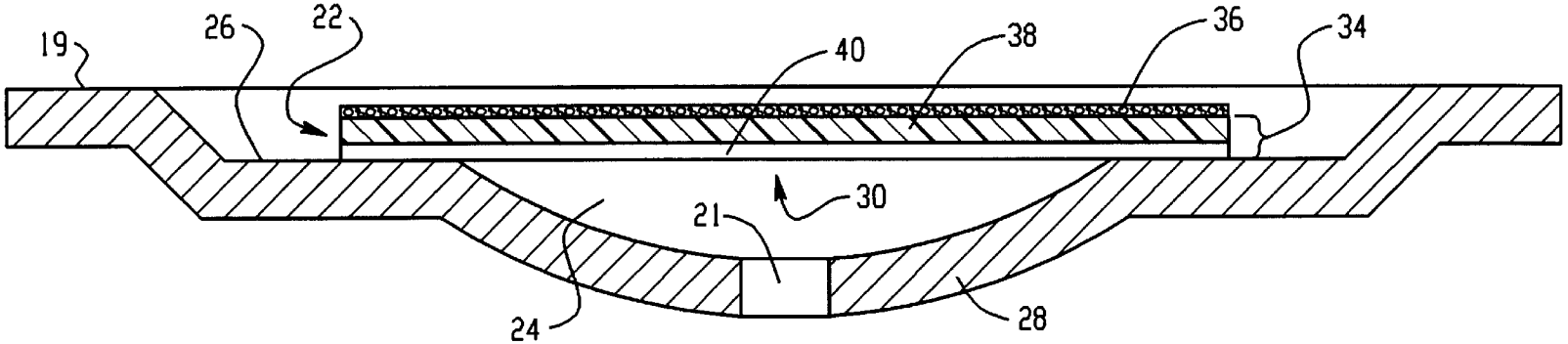
FIG. 3 is an enlarged side sectional view of a filtered venting system according to a second embodiment of the present invention.
Figure 4:
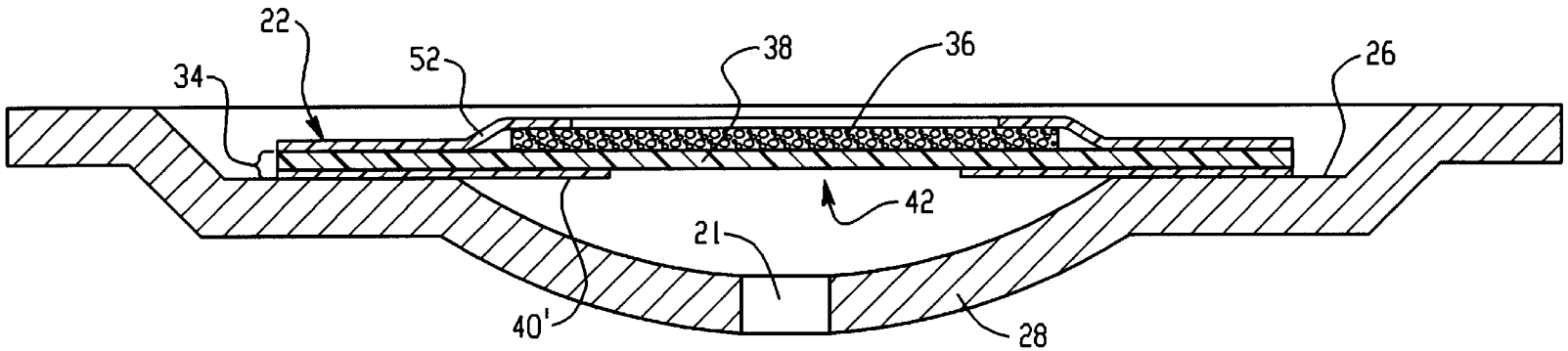
FIG. 4 is an enlarged side sectional view of a filtered venting system according to the embodiment of FIG. 2.

In a first preferred embodiment of the barrier layer, shown in FIGS. 3–4, the barrier layer 34 includes a barrier film 38 and a sealing layer 40. The sealing layer 40 is preferably composed of a material that is readily sealed to the side 26 of the container 10. For a high density polyethylene (HDPE) container 10, the sealing layer 40 preferably comprises a thin film of HDPE. Similarly, for a polypropylene container 10, the sealing layer 40 is optimally also polypropylene. Effective bonding is then readily achieved by ultrasonically or heat welding the sealing layer 40 to the side 26. In a first version of this embodiment, shown in FIG. 3 the sealing layer is formed as a thin coating which is sprayed onto a lower surface of the barrier film 38. The coating 40 can be very thin, as long as it provides good bonding to the container side 26, and need not provide structural strength to the barrier layer 34. In a second version of this embodiment, the sealing layer is formed from a sheet and bonded to a lower surface of the barrier film by ultrasonic welding, glueing, or other suitable method. One preferred method of bonding is to adhere the barrier film and sealing layer together with a layer of ethylene/vinyl alcohol (not shown). In this embodiment, the sheet may be shaped in the form of a continuous layer, such as a disc, or as an annulus 40', with a central opening 42 as shown in FIGS. 2 and 4.

The disc-shaped, first version resembles the coated version of FIG. 3 in cross section and provides an additional barrier to the passage of air and cleaning fluid during shipment and storage. In this first version, the sealing layer 40 fractures when pressure is applied to the multi-layer film.

The annular, second version of the sealing layer 40', shown in FIGS. 2 and 4 provides an annular region for adhering the barrier layer 34 to the side 26 of the container, while also providing a central, opening 42 which permits the passage of air when the barrier film is broken, as will be discussed later. The annular shape of the sealing layer 40' also focusses stresses on the barrier layer, causing it to crack preferentially within the central, exposed region, when pressure is applied to the multi-layer film. The sealing layer of this version need not itself fracture.

In either version of the first embodiment, the barrier film 38 acts as a barrier to the passage of air and cleaning fluid and is highly resistant to degradation by the solvents used in the fluid. In the event that the sealing layer 40 is degraded or dissolved by the solvents during transit, the barrier film 38 functions as the only barrier. Because of its intermediate position, between the sealing layer and the filter layer 36, the range of materials suitable for constructing the barrier film 38 is not limited to those that are readily bonded to the side 26. The barrier film 38 is sufficiently brittle that it fractures when pressure is applied, creating fissures which permit air to flow through the barrier layer 34. A particularly preferred barrier film 38 comprises aluminum. Aluminum has the advantage that it is formable into an extremely thin film, which retains its barrier properties until fractured. Other occlusive materials, such as polyvinylidene dichloride (PVDC) may be used where the cleaning fluid is corrosive towards aluminum.

Figure 5:
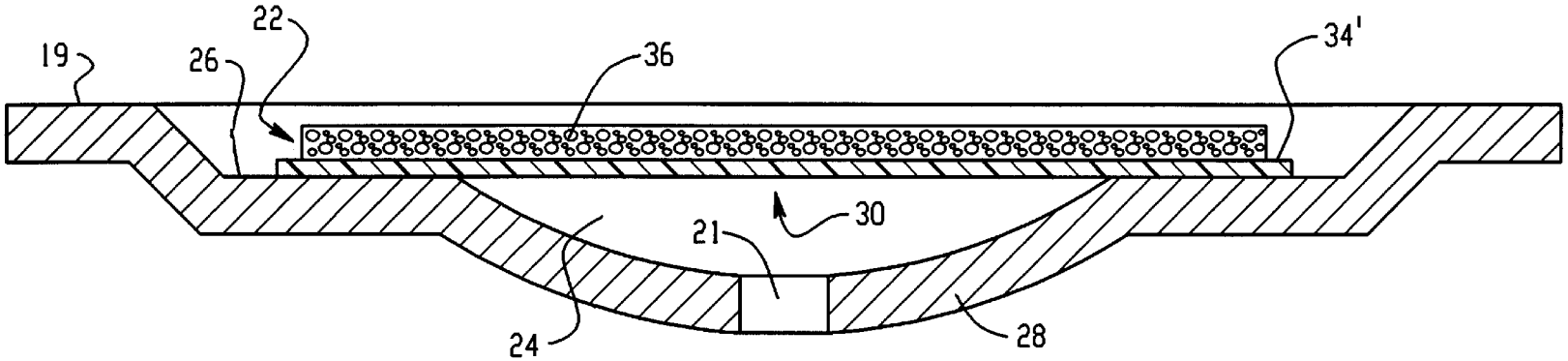
FIG. 5 is an enlarged side sectional view of a filtered venting system according to a third embodiment of the present invention.
Figure 6:
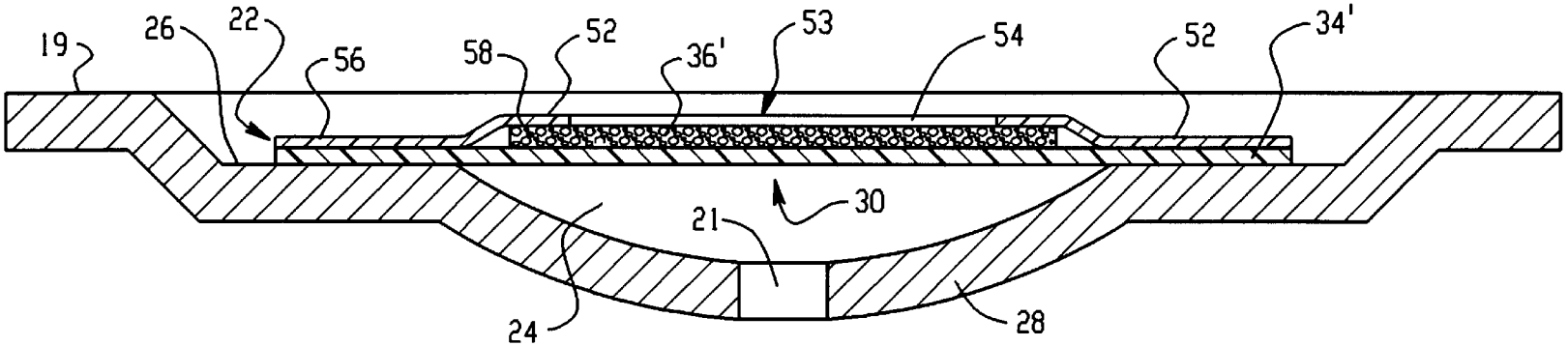
FIG. 6 is an enlarged side sectional view of a filtered venting system according to a fourth embodiment of the present invention.

In a second preferred embodiment of the barrier layer, shown in FIGS. 5 and 6 the barrier layer 34' comprises a single layer of a material which performs the functions of both a sealing layer and a barrier film. The barrier layer is thus readily bondable to the container side 26, and yet also acts as a barrier to the passage of air and cleaning fluid and is highly resistant to degradation by the solvents used in the fluid. As for the sealing layer of the previous embodiment, the barrier layer of this embodiment is preferably composed of a material which is similar to that of the container side. For a high density polyethylene (HDPE) container 10, the barrier layer 34' preferably comprises a film of HDPE. Similarly, for a polypropylene container 10, the barrier layer 34' of this embodiment is optimally also polypropylene. Effective bonding is then readily achieved by ultrasonically or heat welding the barrier layer 34' to the side 26 of the container. In this embodiment the barrier layer has a sufficient thickness and lack of porosity so that it inhibits the passage of cleaning fluid and air therethrough, but is sufficiently frangible that it breaks when extended to permit the passage of air.

The second, filter layer 36 is an extensible air permeable layer that acts as a bioburden filter. Pores in the second layer 36 (not shown) are large enough to allow passage of air while trapping particles such as microorganisms and other undesirable airborne matter.

Preferably, the second layer filters out particles of around $0.3\mu$ or greater from air passing through the second layer. The first, barrier layer 34 prevents fluid in the container from reaching and blocking the pores in the second layer 36 during transit. A particularly preferred second layer 36 is one comprising micro-porous foamed polytetrafluoroethylene (PTFE) film, such as Gore-tex® or similar hydrophobic filter media. PTFE in this form has good elongation properties (6–8 times greater elongation than HDPE or polypropylene), and a porous structure which allows air to pass through but is relatively impermeable to liquids, such as water, and to microorganisms.

The filter layer 36 covers at least a central portion of the barrier layer 34. In a first embodiment of the filter layer, shown in FIGS. 3 and 5, the filter layer covers the portion of the barrier layer which extends over the mouth 30. In this embodiment, the filter layer is sealed around at least a peripheral edge 44 to the upper surface of the barrier layer 34 to provide an airtight seal between the filter layer and the barrier layer. Ultrasonic welding and bonding with a layer of ethylene/vinyl alcohol are two preferred sealing methods, although other methods of sealing, such as those discussed above, are also contemplated. When the upper surface of the barrier layer is that of an aluminum barrier film 38, the preferred method of sealing is ultrasonic welding.

Figure 7:
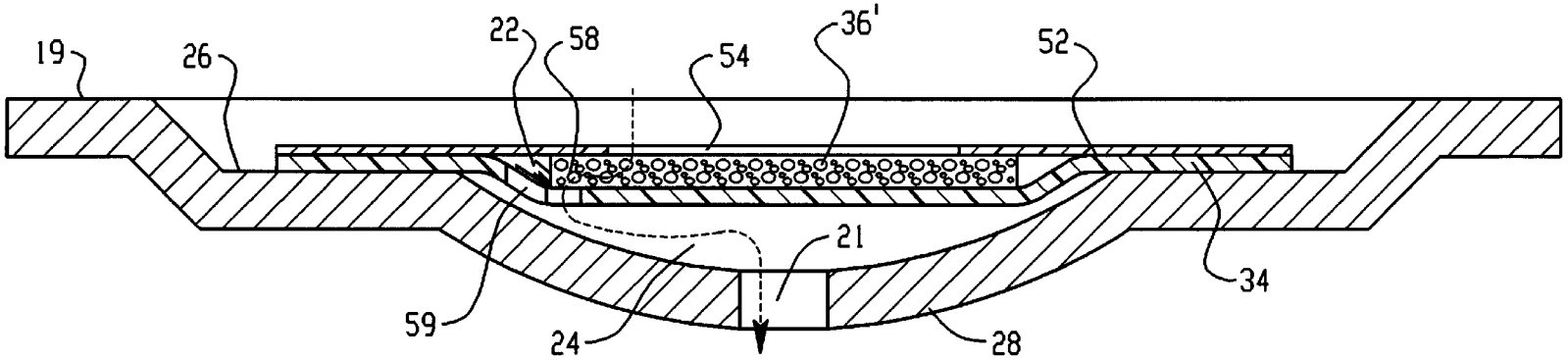
FIG. 7 is an enlarged side sectional view of a filtered venting system according to the embodiment of FIG. 6, showing the multi-layer film stretched and a barrier layer fissured.
Figure 8:
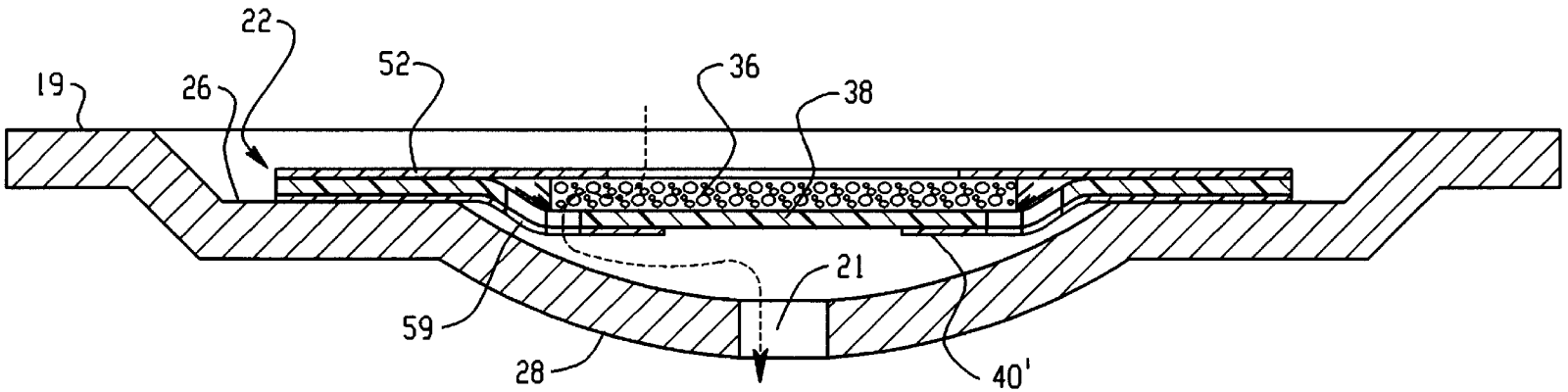
FIG. 8 is an enlarged side sectional view of a filtered venting system according to the embodiment of FIG. 2, showing the multi-layer film stretched and a barrier layer fissured.
Figure 9:
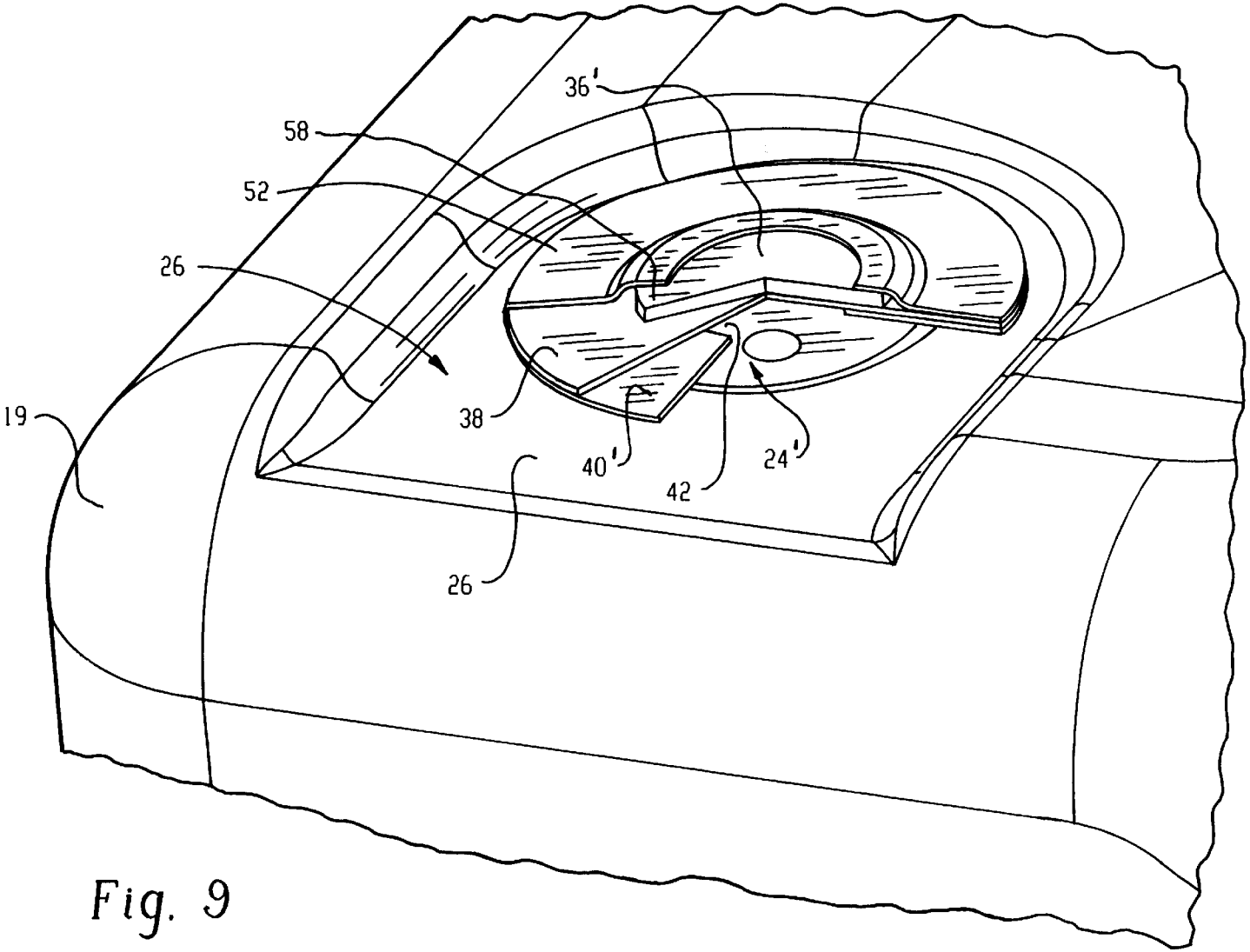
FIG. 9 is an enlarged perspective view, in partial section, of a container side wall and filtered venting system according to the embodiment of FIG. 2.

In a second embodiment of the filter layer, shown in FIGS. 2, 4, 6, and 9 only a central portion of the barrier layer 34 is covered by a filter layer 36'. This reduces the amount of filter material used in the multi-later film. To prevent air ingress through portions of the barrier layer not covered by the filter layer once the barrier layer has been broken, a third layer 52 in the shape of an annulus is sealed over the exposed portion of the barrier layer. Specifically, the third layer 52 is centered over the recess 24 and is sealed to filter layer exposing only a central portion 53 of the filter layer through an opening 54 in the center of the third layer. The lower surface of the third layer 52 is sealed adjacent an outer, peripheral edge 56 to the upper surface of the barrier layer 34 using an adhesive or other method of sealing. Pressure sensitive adhesives are preferred. The third layer extends over a peripheral edge 58 of an the upper surface of the filter layer 36', adjacent the opening 54. The lower surface of the third layer is sealed to the outer edge 58 of the filter layer such that air entering the recess must pass through the filter layer 36'. Similar methods to those used for sealing the third layer to the barrier layer are used for sealing the third layer to the outer edge of the filter layer. When the multi-layer film is depressed, the peripheral edge 58 of the filter layer creates stresses in the adjacent barrier layer causing it to form cracks 59, particularly in the region adjacent the peripheral edge 58 of the filter, as shown in FIGS. 7 and 8. This creates a passageway for air to enter the container.

The third layer is formed from an extensible or flexible material which does not fracture when pressure is applied to the multi-layer film to fracture the barrier layer. One preferred material for the third layer is polyvinylidene dichloride, although other extensible or flexible, and relatively air-impermeable, materials are also contemplated.

Although the film 22 has been described as having two or three layers, the invention is not limited to a maximum of three layers. It is envisaged that the film 22 could include multiple layers. For example, an outer layer of HDPE, adjacent the filter layer 36, or third layer 52, where present, would provide protection to the filter layer during transit, preventing contamination or clogging of the pores of the second layer with dirt. For convenience, however, the multi-layer film 22 will be described herein as comprising the two, or optionally three layers 34, 36, and 52. Moreover, while the recess mouth 30 and the layers of the multi-layer film have been described as having circular peripheries, it should be appreciated that other geometries are also contemplated. For example, the recess 24 may take the shape of an open box and the layers of the film have corresponding rectangular peripheries. The important feature is that the barrier layer 34 and filter layer 36, or the barrier layer and third layer 52, when present, cover the opening 30.

When downward pressure is applied to the multi-layer film, the barrier layer 34,34' fractures, allowing air to pass through the aperture 21 and into the container. The filter layer 36 extends without fracture, in the case of the embodiment of FIGS. 3 and 5. In the embodiment of FIGS. 2,4, 4, and 7–8, the filter layer 36' is not subjected to as much deflection as the barrier layer 34,34' and thus does not tend to fracture. In addition, the filter layer 36' is preferably more extensible than the barrier layer, stretching when depressed.

The integrity of barrier layer 34,34' (in particular, the barrier film 38, and continuous sealing layer 40, where these are present) is purposely destroyed before dispensing fluid so that air passes freely through the film 22. This is preferably achieved by stretching the multi-layer film 22 so that barrier layer forms multiple cracks. The fracture-free elongation of the filter layer 36,36' and optional third layer 52, is significantly greater than that of the barrier layer 34,34'. As a result, when the multi-layer film 22 is deformed, such as by pressing an instrument against the film 22, the filter layer 36,36' stretches or is displaced without cracking while the barrier layer 34,34' tears, and porous fissures 59 are formed. When an annular sealing layer 40' is used, as shown in FIGS. 2 and 4, the sealing layer need not fissure, since air passes through the central opening.

Figure 10:
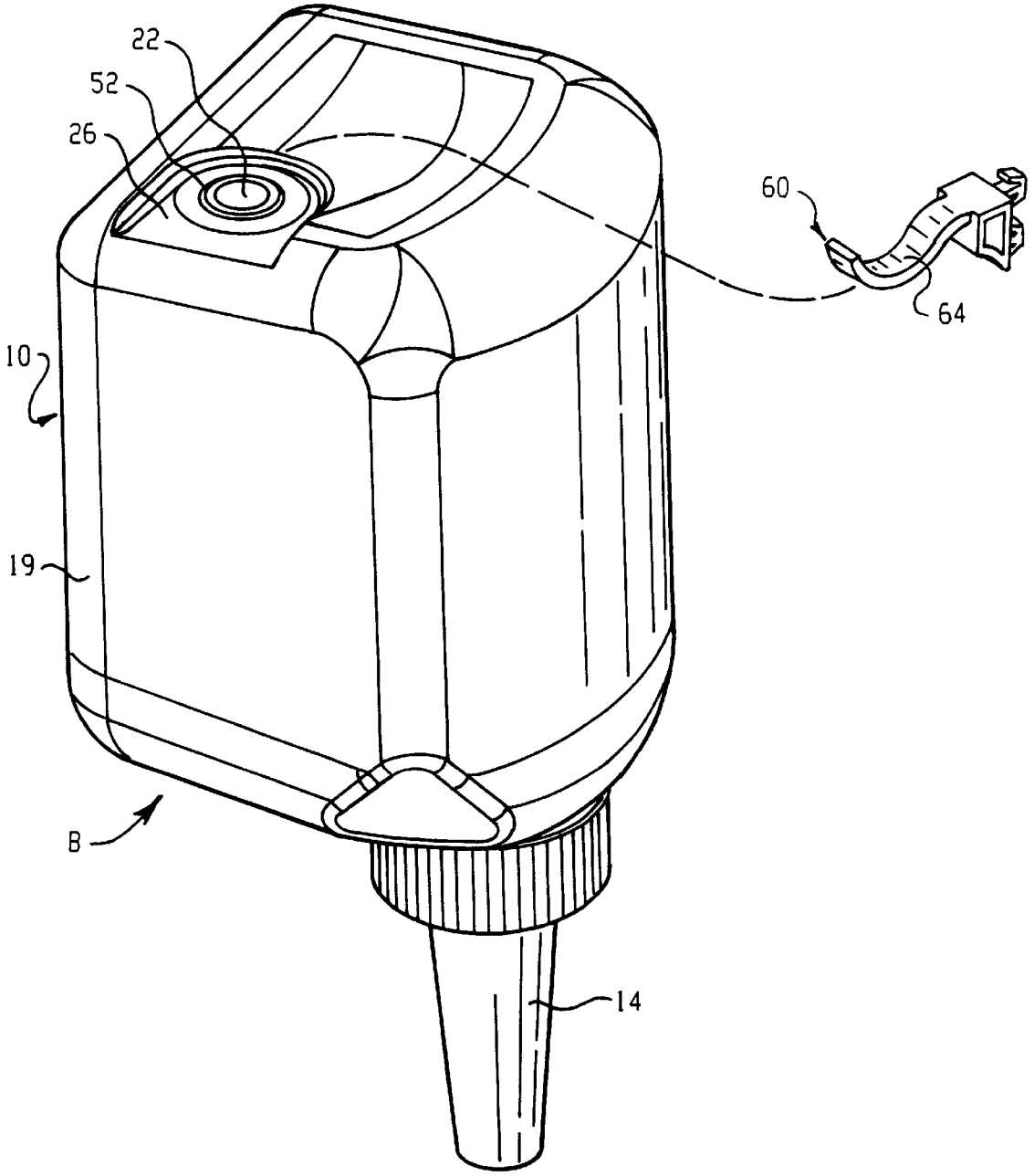
FIG. 10 is an exploded side perspective view of the container and detent of FIG. 1.
Figure 11:
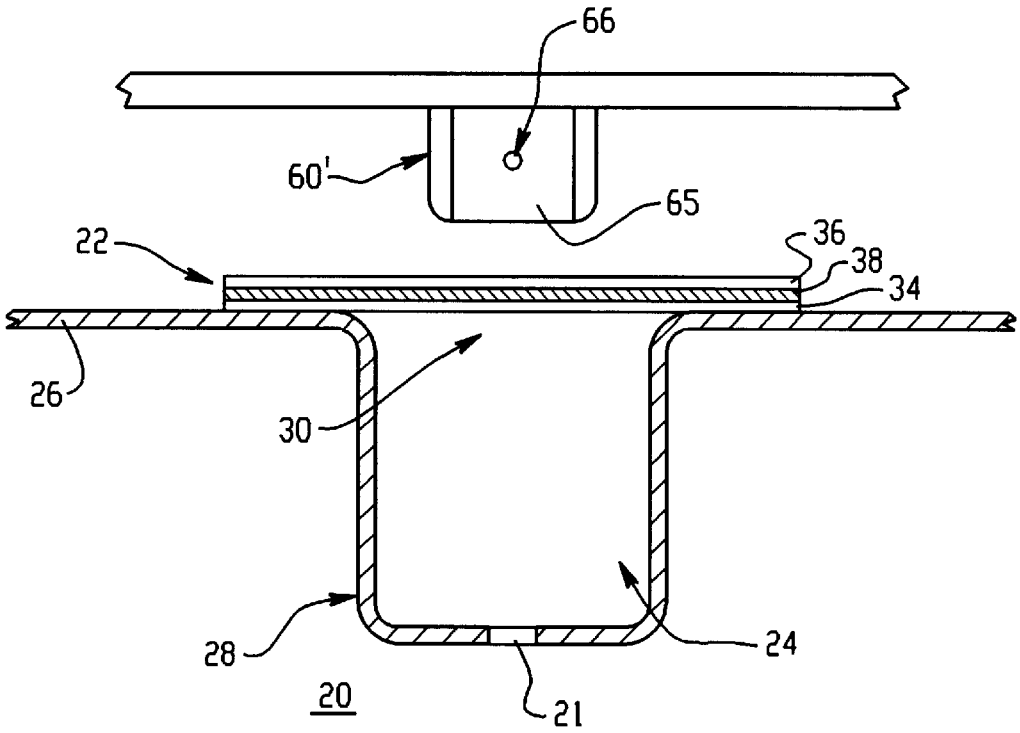
FIG. 11 is an enlarged schematic side view of an alternative embodiment of a filtered venting system and detent according to the present invention.

With reference to FIGS. 10 and 11, a boss or detent 60, shaped to be received within the recess 24 conveniently applies pressure to the multi-layer film to stretch the layers 34, 36, and optionally 52. In a preferred embodiment, shown in FIG. 1, the detent 60 extends from an upper portion 62 of housing 12. The detent 60 and recess 24 are shaped and disposed such that, as the container 10 is positioned within the housing 12 for dispensing, the detent engages the recess, stretching the multi-layer-film 22 sufficiently to crack the barrier layer 34 in the process. Specifically, when a front cover 63 of the housing is closed, a downward pressure is applied to the detent 60. The detent includes a flexible portion 64 which flexes under the downward pressure, fracturing the barrier layer 34. Alternatively, the detent 60 is a the tip of a finger or forms part of a tool that is removed after stretching the film 22.

Figure 12:
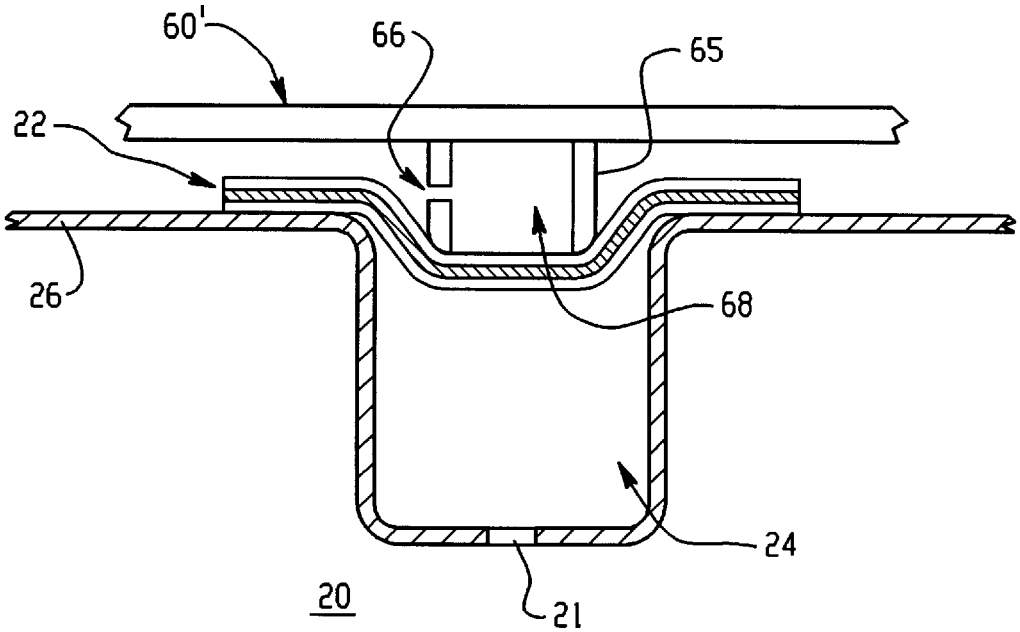
FIG. 12 is a schematic side view of the filtered venting system and detent of FIG. 11, showing the detent engaging a recess in the container wall.

Preferably, as shown in FIGS. 1 and 10, the detent is shaped so that air flows round the sides of the detent and through the film. Alternatively, as shown in FIGS. 11 and 12 the detent 60' includes detent walls 65. One or more orifices 66 are disposed in the detent walls 65. The orifices 66 increase the flow of air into the recess 24 by allowing air to enter an interior 68 of the detent 60 through the orifice 66 and pass therefrom through the film 22.

The invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A multi-layer film adapted for sealing an opening in a vessel and selectively permitting air substantially free of airborne contamination to pass through the opening, the film comprising:

a first layer of a filter material which is permeable to air but is substantially impermeable to the airborne contaminants;

a second layer of a barrier material which is impermeable to air and which fissures when a pressure is applied to a surface of the film permitting filtered air through the film and which is adapted for being sealed around a periphery of the opening.

2. The multi-layer film of claim 1, wherein the barrier layer includes a sealing layer which is formed from a material that is readily sealed to the vessel to provide an airtight seal between the barrier layer and the vessel.

3. A fluid dispensing system for dispensing fluids susceptible to airborne contamination, the system comprising:

a reservoir including:

a container for holding the fluid, a dispensing tube for dispensing fluid from the container, and an aperture defined in the container for admitting air to the container;

a multi-layer film covering the aperture which selectively seals the aperture during transit and storage of the container and filters air entering the container during dispensing of the fluid; and a housing for supporting the reservoir.

4. The dispensing system of claim 3, wherein the multi-layer film is bonded to the outside of the container by sealing the multi-layer film to the container in an annulus surrounding the aperture.

5. The dispensing system of claim 3, wherein the container further includes a recess, the aperture being disposed in the recess.

6. The dispensing system of claim 3, wherein the multi-layer film includes a barrier layer and a filter layer, the barrier layer comprising a thin film of a material which is resistant to the permeability of air, and the filter layer comprising a material which is permeable to air but substantially impermeable to an airborne contaminant;

whereby a pressure on the multi-layer film causes air-permeable fissures to form in the barrier layer thereby allowing air to enter the container.

7. The dispensing system of claim 6, wherein the filter material has a greater extensibility than the barrier material.

8. The dispensing system of claim 6, wherein the barrier layer of the multi-layer film is disposed between the filter layer and an interior of the container.

9. The dispensing system of claim 8, wherein the barrier layer of the multi-layer film is resistant to degradation by components of the fluid and prevents the fluid from blocking the filter layer during transit and storage of the container.

10. The dispensing system of claim 8, wherein the filter layer of the multi-layer film comprises a hydrophobic microporous foam.

11. The dispensing system of claim 10, wherein the filter layer comprises a polytetrafluoroethylene foam having a pore size that filters particles having a size of about $0.3\mu$ or greater.

12. The dispensing system of claim 6, wherein the barrier layer comprises a film of the same material as the container and the multi-layer film is bonded to the container by welding the barrier layer to the container by a method from the group comprising ultrasonically welding, heat welding, and radio-frequency welding.

13. The dispensing system of claim 12, wherein the barrier layer comprises a film of polyethylene and is ultrasonically welded to the container.

14. The dispensing system of claim 6, wherein the barrier layer of the multi-layer film is bonded to the filter layer by a layer of ethylene/vinyl alcohol.

15. The dispensing system of claim 6, wherein the barrier layer includes:

a sealing layer; and, a barrier film, the sealing layer being disposed between the barrier film and the container, the sealing layer being formed from a material which is readily sealed to the container.

16. The dispensing system of claim 15, wherein the sealing layer and the barrier film both act as barriers to air and fluid movement through the multi-layer film;

and wherein the stretching of the multi-layer film causes air-permeable fissures to form in the sealing layer and in the barrier film, thereby allowing air to enter the container.

17. The dispensing system of claim 16, wherein the barrier film is resistant to degradation by a component of the fluid and acts as a barrier in the event of degradation or penetration of the sealing layer by the component during transit or storage of the container.

18. The dispensing system of claim 15, wherein the barrier film comprises a thin film of aluminum.

19. The dispensing system of claim 15, wherein the sealing layer comprises a film of the same material as the container and the multi-layer film is bonded to the container by welding the sealing layer to the container by a method selected from the group consisting of ultrasonically welding, heat welding, radio-frequency welding, and combinations thereof.

20. The dispensing system of claim 15, wherein the sealing layer comprises an annular ring with a central opening.

21. The dispensing system of claim 6, wherein:

the filter layer covers a central portion of the barrier layer; and, the multi-layer film further includes a third layer which covers an exposed portion of the barrier layer that is not covered by the filter layer.

22. The dispensing system of claim 6, wherein the container further includes a recess, the aperture disposed in the recess, the multi-layer film bonded to the outside of the container by sealing the multi-layer film to the container in an annulus surrounding the recess, and wherein the housing includes a detent for depressing the film into the recess, thereby stretching the multi-layer film.

23. A method for preventing airborne contaminants from contaminating the contents of a container with a vent aperture, the method comprising:

a) attaching a multi-layer film to the container, the film including a first, barrier layer, which fractures with stretching, to seal the aperture during transit and storage of the container, and a second, porous layer which filters air entering the container through the aperture;

b) shipping or storing the container;

c) fracturing the barrier layer; and, d) filtering out the contaminants from air entering the container through the aperture.

24. The method of claim 23, wherein the step of fracturing the barrier layer includes stretching the barrier layer.

25. The method of claim 24, wherein the aperture is disposed in a recess in the container, the step of covering the aperture further includes sealing the multi-layer film over a mouth in the recess, and the step of fracturing the barrier layer includes:

applying pressure to the film, thereby stretching the barrier layer.

26. The method of claim 23, further including after step a):

filling the container with a fluid and, after step c):

dispensing the fluid from the container through a dispensing tube.

27. A fluid dispenser refill comprising:

a container for holding a fluid which is susceptible to airborne contamination;

a dispensing tube for dispensing fluid from the container;

a vent aperture defined in the container for admitting air to the container;

a multi-layer film covering the aperture which film includes a frangible barrier layer which seals the vent aperture during transit and storage and a filter layer which after the frangible layer is fractured filters the airborne contamination from air entering the container through the vent aperture during dispensing of the fluid.

* * * * *